US011626057B1

(12) United States Patent
Park et al.

(10) Patent No.: US 11,626,057 B1
(45) Date of Patent: Apr. 11, 2023

(54) REAL-TIME COLOR CONVERSION IN DISPLAY PANELS UNDER THERMAL SHIFTS

(71) Applicant: Meta Platforms Technologies, LLC, Menlo Park, CA (US)

(72) Inventors: Yongmin Park, Sammamish, WA (US); Haomiao Jiang, Sunnyvale, CA (US); Zhang Jia, Sunnyvale, CA (US); Xiaobo Tian, Sunnyvale, CA (US); Agnes Lee, Saratoga, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/711,311

(22) Filed: Apr. 1, 2022

(51) Int. Cl.
*G09G 3/20* (2006.01)
*G09G 3/00* (2006.01)

(52) U.S. Cl.
CPC ..... *G09G 3/2003* (2013.01); *G09G 3/001* (2013.01); *G09G 2320/0242* (2013.01); *G09G 2320/0276* (2013.01); *G09G 2320/041* (2013.01); *G09G 2320/0666* (2013.01); *G09G 2320/0673* (2013.01); *G09G 2320/0693* (2013.01); *G09G 2340/06* (2013.01)

(58) Field of Classification Search
CPC ..... G09G 3/001; G09G 3/2003; G09G 2320/0242; G09G 2320/0276; G09G 2320/041; G09G 2320/0666; G09G 2320/0673; G09G 2320/0693; G09G 2340/06
See application file for complete search history.

(56) References Cited

U.S. PATENT DOCUMENTS 8,773,451 B2 * 7/2014 Marcu ..... G09G 3/2003 345/589
9,361,822 B2 * 6/2016 Ho ..... G09G 3/2003
10,748,494 B1 * 8/2020 Ho ..... G02B 27/017
2010/0091032 A1 * 4/2010 Ueki ..... G09G 5/026 345/590

(Continued)

FOREIGN PATENT DOCUMENTS

WO WO-2007036756 A1 * 4/2007 ..... G03B 7/00

*Primary Examiner* — Kenneth Bukowski
(74) *Attorney, Agent, or Firm* — Fenwick & West LLP

(57) ABSTRACT

Embodiments of the present disclosure relate to a display assembly with color calibration for improving accuracy of displayed colors under thermal shifts. A data processing circuit of the display assembly determines color compensation coefficients corresponding to an operating temperature of a display panel, each color compensation coefficient accounting for a thermal shift of a respective color component at the operating temperature. The data processing circuit applies the color compensation coefficients to color transform elements corresponding to an initial temperature to determine a corrected version of the color transform elements corresponding to the operating temperature. The data processing circuit processes pixel values of color components in a first format associated with the display panel at the operating temperature by applying the corrected version of the color transform elements to generate corrected pixel values of the color components in a second format for presentation on the display panel at the operating temperature.

18 Claims, 8 Drawing Sheets

(56) References Cited

U.S. PATENT DOCUMENTS

| | | | | |
|---|---|---|---|---|
| 2010/0091039 | A1* | 4/2010 | Marcu | G09G 5/06 345/690 |
| 2011/0032275 | A1* | 2/2011 | Marcu | G09G 3/2003 345/690 |
| 2017/0330498 | A1* | 11/2017 | Orio | G09G 5/10 |
| 2018/0197503 | A1* | 7/2018 | Sasaki | G09G 3/002 |
| 2021/0097918 | A1* | 4/2021 | Wang | G09G 3/2003 |

* cited by examiner

200

REAL-TIME COLOR CONVERSION IN DISPLAY PANELS UNDER THERMAL SHIFTS

FIELD OF THE INVENTION

The present disclosure relates generally to a display device, and specifically relates to real-time color conversion in display panels under thermal shifts.

BACKGROUND

Electronic devices (e.g., head-mounted displays) often employ display devices such as liquid crystal displays (LCDs). Color, luminance, and gamma curves of such display devices typically shift with temperature. Because the conventional color calibration for the display devices is performed at a normal room temperature (e.g., between 25° C. and 30° C.), a color transform matrix and gamma curve tuned to the normal room temperature may not produce accurate color when the display devices operate at higher operating temperatures (e.g., between 40° C. and 60° C.). The change in the reproduced color may degrade the user experience of the electronic devices and productivity of the user.

SUMMARY

Embodiments of the present disclosure relate to performing a color calibration under thermal shifts for improving accuracy of displayed colors in a display assembly. The display assembly may include a display panel configured to display color images, and a data processing circuit coupled to the display panel. The data processing circuit may determine a plurality of color compensation coefficients corresponding to an operating temperature of the display panel where each of the color compensation coefficients accounting for a thermal shift of a respective color component of a plurality of color components at the operating temperature. The data processing circuit may apply the determined color compensation coefficients to a plurality of color transform elements corresponding to an initial temperature to determine a corrected version of the plurality of color transform elements corresponding to the operating temperature, the plurality of color transform elements transforming the plurality of color components from a first format to a second format. The data processing circuit may process pixel values of the plurality of color components in the first format associated with the display panel at the operating temperature by applying the corrected version of the plurality of color transform elements to the pixel values to generate corrected pixel values of the plurality of color components in the second format for presentation on the display panel at the operating temperature. The data processing circuit may instruct the display panel to present the corrected pixel values. The display panel may be part of a headset.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Color, luminance, and gamma curves of display panels typically shift with operating temperatures of the display panels. Because the conventional color calibration for a display panel is performed at a normal room temperature (e.g., between 25° C. and 30° C.), a color transform matrix and gamma curve obtained at that temperature would provide wrong colors at the display panel typically operating at higher temperatures (e.g., between 40° C. and 60° C.). Embodiments of the present disclosure relate to process (or method) of color calibration under thermal shifts at a display assembly to improve accuracy of colors presented at a display panel of the display assembly. The process of color calibration implemented at the display assembly may adjust a color transform matrix and gamma curve with real-time temperature information.

The display device presented herein may be integrated into a wearable device (e.g., headset), a mobile device, or any other hardware platform capable of providing artificial reality content to a user.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Figure 1A:
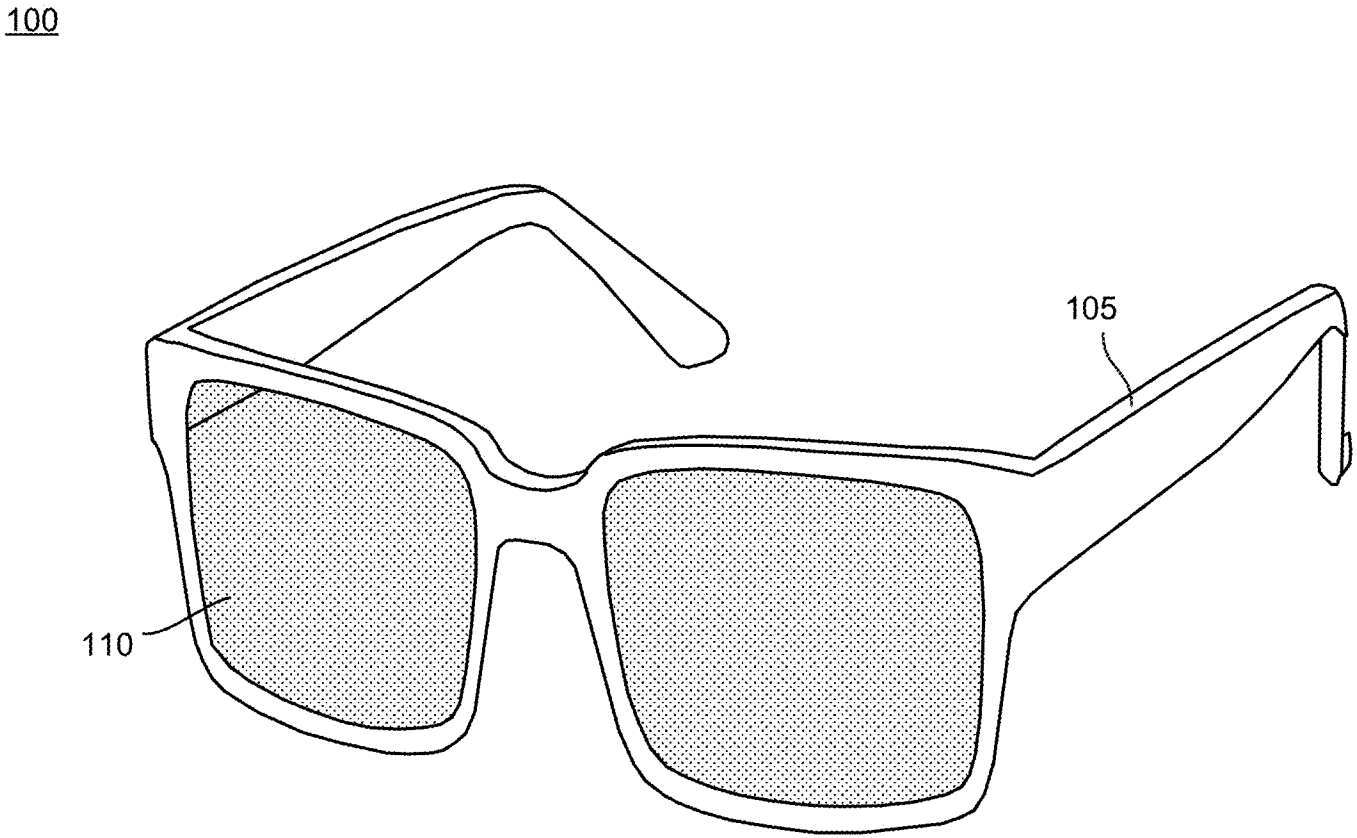
FIGS. 1A and 1B are diagrams of head-mounted displays (HMDs) that include near-eye displays (NEDs), according to some embodiments.
Figure 1B:
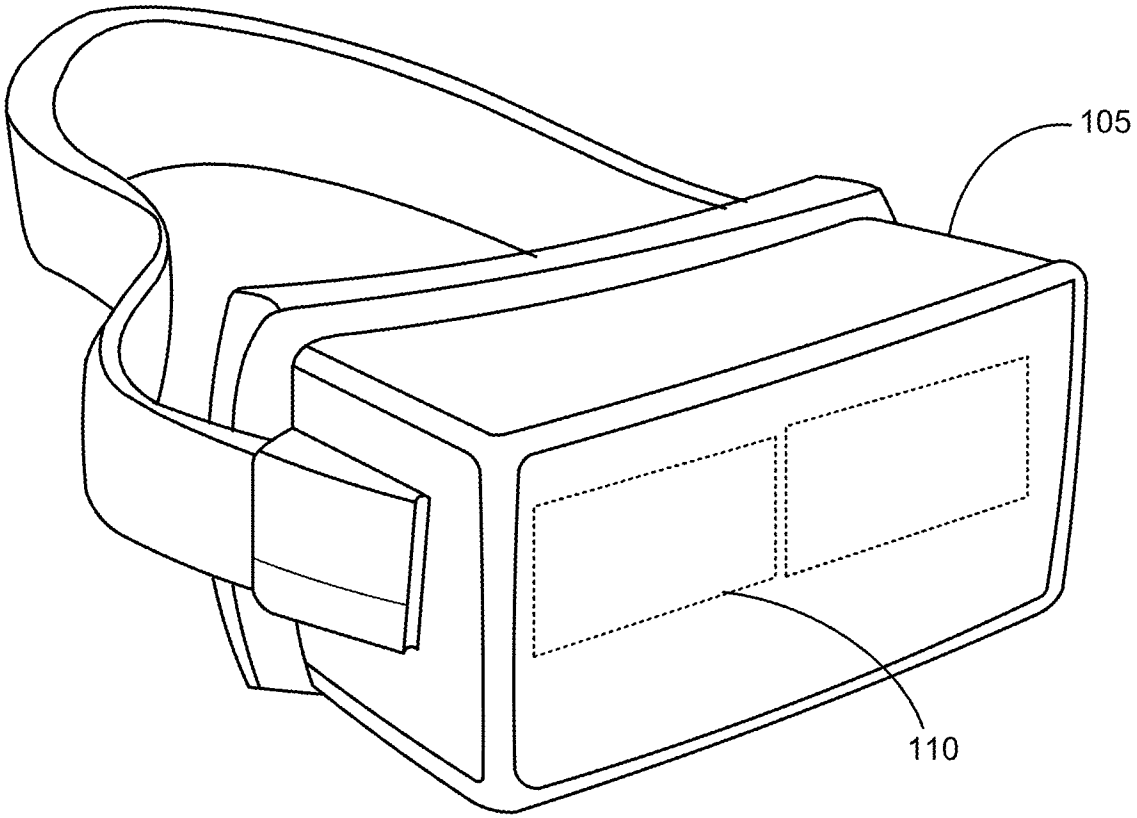

FIGS. 1A and 1B are diagrams of head-mounted displays (HMDs) 100 that include near-eye displays (NEDs) 110, according to some embodiments. The NED 110 may present media to a user. Examples of media that may be presented by the NED 110 include one or more images, video, audio, or some combination thereof. In some embodiments, audio may be presented via an external device (e.g., speakers and/or headphones) that receives audio information from the HMD 100, a console (not shown), or both, and presents audio data to the user based on the audio information. The HMD 100 is generally configured to operate as a virtual reality (VR) HMD. However, in some embodiments, the HMD 100 may be modified to also operate as an augmented reality (AR) HMD, a mixed reality (MR) HMD, or some combination thereof. For example, in some embodiments, the HMD 100 may augment views of a physical, real-world environment with computer-generated elements (e.g., still images, video, sound, etc.).

The HMD 100 shown in FIG. 1A or 1B may include a frame 105 and a display 110. The frame 105 may include one or more optical elements that together display media to a user. That is, the display 110 may be configured for a user to view the content presented by the HMD 100. As discussed below in conjunction with FIG. 2, the display 110 may include at least one source assembly to generate image light to present optical media to an eye of the user. The source assembly may include, e.g., a source, an optics system, or some combination thereof.

FIGS. 1A and 1B are merely examples of a virtual reality system, and the display systems described herein may be incorporated into further such systems.

Figure 2:
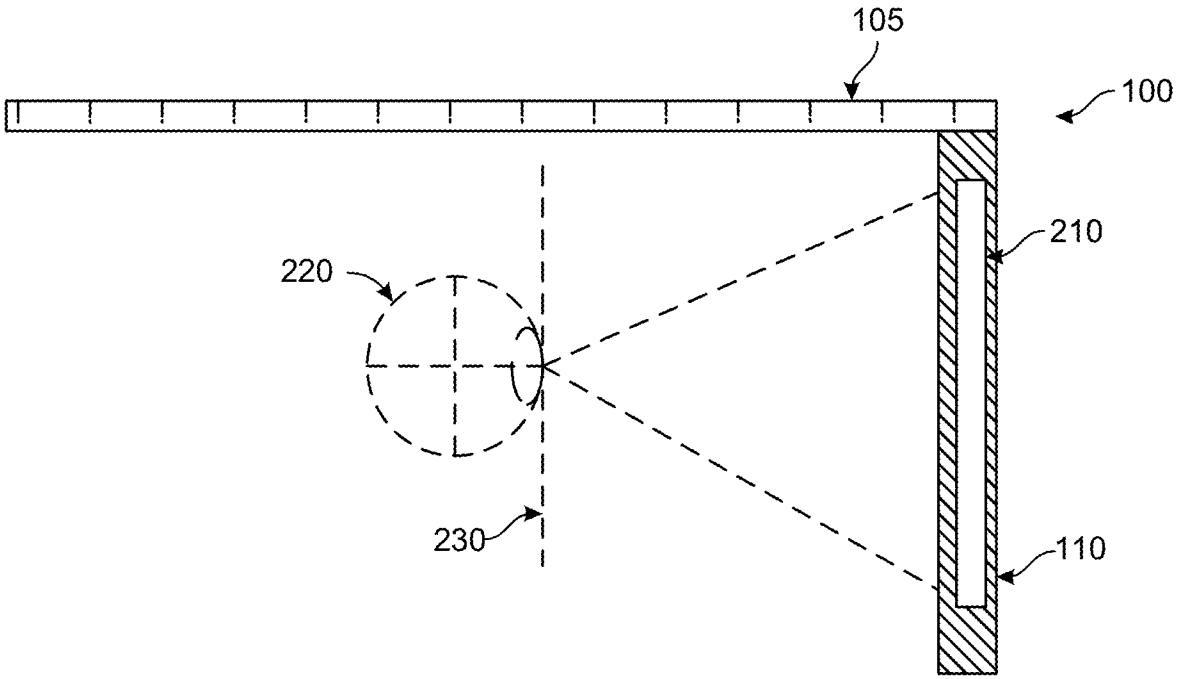
FIG. 2 is a cross-sectional view of the HMD illustrated in FIG. 1A or FIG. 1B, according to some embodiments.

FIG. 2 is a cross section 200 of the HMD 100 illustrated in FIG. 1A or FIG. 1B, according to some embodiments. The cross section 200 may include at least one display assembly 210, and an exit pupil 230. The exit pupil 230 is a location where an eye 220 may be positioned when a user wears the HMD 100. In some embodiments, the frame 105 may represent a frame of eye-wear glasses. For purposes of illustration, FIG. 2 shows the cross section 200 associated with a single eye 220 and a single display assembly 210, but in alternative embodiments not shown, another display assembly that is separate from or integrated with the display assembly 210 shown in FIG. 2, may provide image light to another eye of the user.

The display assembly 210 may direct the image light to the eye 220 through the exit pupil 230. The display assembly 210 may be composed of one or more materials (e.g., plastic, glass, etc.) with one or more refractive indices that effectively decrease the weight and widen a field of view of the HMD 100.

In alternate configurations, the HMD 100 may include one or more optical elements (not shown) between the display assembly 210 and the eye 220. The optical elements may act to, by way of various examples, correct aberrations in image light emitted from the display assembly 210, magnify image light emitted from the display assembly 210, perform some other optical adjustment of image light emitted from the display assembly 210, or combinations thereof. Example optical elements may include an aperture, a Fresnel lens, a convex lens, a concave lens, a filter, or any other suitable optical element that may affect image light.

In some embodiments, the display assembly 210 may include a source assembly to generate image light to present media to a user's eyes. The source assembly may include, e.g., a light source, an optics system, or some combination thereof. In accordance with various embodiments, a source assembly may include a light-emitting diode (LED) such as an organic light-emitting diode (OLED). In accordance with various embodiments, the display assembly 210 may be implemented as a liquid crystal display (LCD) assembly, OLED display assembly, or some other type of display assembly configured to emit color image light to the eye 220.

Figure 3:
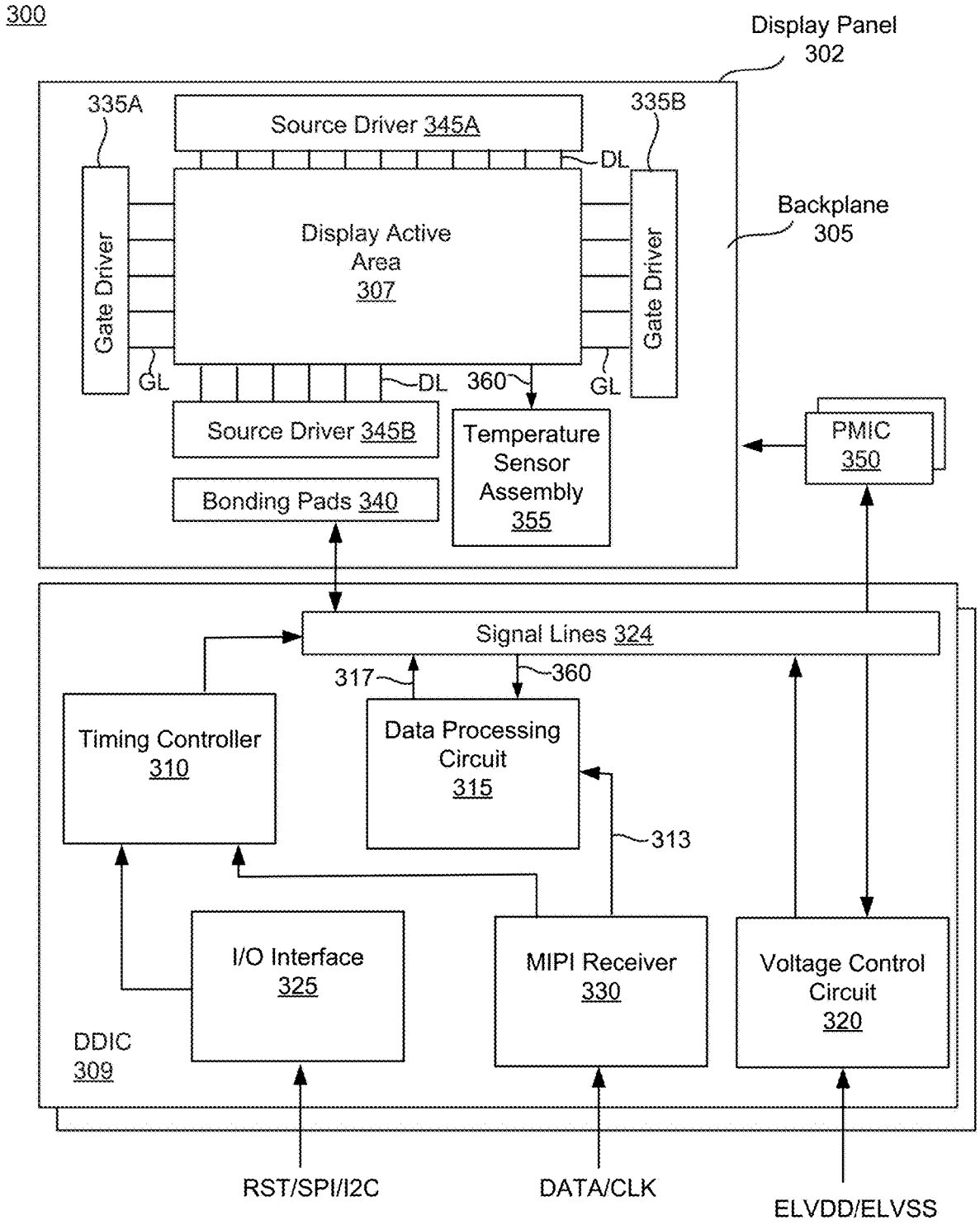
FIG. 3 is a schematic view of a display assembly, according to some embodiments.

FIG. 3 is a schematic view of a display assembly 300, according to some embodiments. The display assembly 300 may be an embodiment of the display assembly 210. The display assembly 300 may be an LCD display assembly, an OLED display assembly, or some other type of a display assembly. The display assembly 300 may include, among other components, one or more display driver integrated circuits (DDICs) 309, one or more power management integrated circuits (PMICs) 350, and a display panel 302.

The display panel 302 includes a display active area 307 that displays images according to timing signals and data signals from the one or more DDICs 309. The display panel 302 includes the display active area 307, bonding pads 340, a temperature sensor 355, gate drivers 335A, 335B (collectively referred to as "gate drivers 335"), and source drivers 345A, 345B (collectively referred to as "source drivers 345") disposed on a backplane 305. Each DDIC 309 may include a timing controller 310, a data processing unit 315, a voltage control circuit 320, an input/output (I/O) interface 325, a mobile industry processor interface (MIPI) receiver 330, and signal lines 324. In other embodiments, one or more components of the DDIC 309 may be disposed in the display panel 302. When there are multiple DDICs 309 in the display assembly 300, each DDIC 309 may operate a different subset of the pixels in the display panel 302. The DDICs 309 may operate in a parallel structure or in a master-slave structure. The display panel 302 is powered by the PMICs 350 according to power control signals from the DDICs 309. Each PMIC 350 may be an integrated circuit including one or more voltage regulators that provide supply voltages (e.g., ELVDD, ELVSS, AVDD) to the display panel 302. In some embodiments, the PMIC 350 may be incorporated into display panel 302 or the DDIC 309. The structure of the display assembly 300 illustrated in FIG. 3 is merely an example, and components in the DDIC 309, the PMIC 350, and the display panel 302 may be interchangeable (e.g., the voltage control circuit 320 may be in the PMIC 350 instead of the DDIC 309).

The timing controller 310 generates timing control signals for the gate driver 335, the source drivers 345, and other components in the display panel 302. The timing controller 310 receives external signals via the I/O interface 325 and the MIPI receiver 330 and processes the external signals to generate the timing control signals. The timing control signals may include a clock, a vertical synchronization signal, a horizontal synchronization signal, and a start pulse. However, timing control signals provided from the timing controller 310 according to embodiments of the present disclosure are not limited thereto.

The data processing circuit 315 receives image data DATA as pixel values 313 from the MIPI receiver 330 and converts a format of the pixel values 313 to generate corrected pixel values 317 input (e.g., via the signal lines 324 and bonding pads 340) to the source drivers 345 for displaying images in the display active area 307. In accordance with embodiments of the present disclosure, the data processing circuit 315 performs color conversion with real-time temperature correction on the pixel values 313 to improve color accuracy of the corrected pixel values 317 under thermal shifts caused by changes in an operating temperature of the display panel 302 (e.g., between 40° C.

and 60° C.) that is higher than a typical color calibration temperature of the display panel 302 (e.g., between 25° C. and 30° C.). More details about a structure of the data processing circuit 315 and operations of the data processing circuit 315 for color conversion with real-time temperature correction are described below in conjunction with FIGS. 4 through 7.

The I/O interface 325 is a circuit that receives control signals from other sources and sends operation signals to the timing controller 310. The control signals may include a reset signal RST to reset the display panel 302 and signals according to serial peripheral interface (SPI) or inter-integrated circuit (I2C) protocols for digital data transfer. Based on the received control signals, the I/O interface 325 may process commands from a system on a chip (SoC), a central processing unit (CPU), or other system control chip.

The MIPI receiver 330 may be a MIPI display serial interface (DSI), which may include a high-speed packet-based interface for delivering video data to pixels (i.e., light emission elements) in the display active area 307. The MIPI receiver 330 may receive image data DATA and clock signals CLK and provide timing control signals to the timing controller 310 and image data DATA (as the pixel values 313) to the data processing unit 315.

The voltage control circuit 320 receives, via the bonding pads 340 and signal lines 324, supply voltages sensed by power detection circuits at a plurality of locations along the power rails in the display panel 302 and generates power control signals to compensate for local voltage changes in the power rails. For each detected supply voltage at a corresponding location, the voltage control circuit 320 determines how much the detected supply voltage is lower or higher than the desired supply voltage. For example, if the desired voltage of the first supply voltage ELVDD is +5V, but the detected first supply voltage ELVDD at a first point along a segment of power rail is +4.6V, the voltage control circuit 320 generates power control signals to cause the PMIC 350 to increase the voltage level of the first supply voltage ELVDD output to a power pad connected to the segment of power rail. The power control signals provided to the PMICs 350 may represent levels of increase or decrease in the supply voltages to be output (e.g., increase the output for the first supply voltage ELVDD to +5.4V). The power control signals are transmitted to the PMICs 350 via the signal lines 324. The voltage control circuit 320 may provide adjusted power control signals to the PMICs 350 once per frame or once per a predetermined number of frames (e.g., 3 frames).

The display active area 307 includes a plurality of pixels (light emission elements) arranged into rows and columns. Each pixel is connected to a gate line GL and a data line DL and driven to emit light according to a respective pixel value of the corrected pixel values 317 received through the connected data line DL when the connected gate line GL provides a gate-on signal to the pixel.

The temperature sensor assembly 355 may measure an operating temperature of the display active area 307. The operating temperature of the display active area 307 may be measured by the temperature sensor assembly 355 at a defined periodicity controlled by, e.g., the timing controller 310. The operating temperature measured by the temperature sensor assembly 355 may be represented as real-time temperature information 360. The temperature sensor assembly 355 may comprise one or more temperature sensors coupled to one or more locations of the display active area 307 (e.g., one or more pixel locations) for measuring one or more operating temperatures in relation to the one or more locations of the display active area 307. Accordingly, the real-time temperature information 360 may represent, e.g., an average value of the one or more measured temperatures, a median value of the one or more measured temperatures, some other function of the one or more measured temperatures, or combination thereof. The real-time temperature information 360 may be provided to the data processing circuit 315 (e.g., via the bonding pads 340 and signal lines 324). The data processing circuit 315 may utilize the real-time temperature information 360 during a color calibration process and a color conversion process before colors are presented at the display active area 307. Details about the color calibration process and color conversion process at the data processing circuit 315 that utilize the real-time temperature information 360 are provided below in relation to FIGS. 5-7.

Color calibration at the display panel 302 aims to adjust colors of pixels to accurately reproduce images at the display active area 307 such that the presented colors are closer to the purported colors. One advantage of performing the color calibration at the display panel 302 is to reduce variances (e.g., white point, gamma level, etc.) across a pair of display active areas 307 of a wearable device (e.g., headset). The color calibration may be carried out to mitigate the discrepancy in luminance between a pair of the display active areas 307 in the headset. For this purpose, (X, Y, Z) values of color components may be measured for corresponding (R, G, B) color component values, and a color transform matrix can be obtained for usage at the data processing circuit 315 as part of a color conversion process, as described below in relation to FIG. 4. The color conversion process may be performed at the data processing circuit 315 for adjusting values of color components in the image data DATA input into the data processing circuit 315 to support different color spaces (e.g., Rec.709, DCI.P3, and Rec.2020) when being presented at the display active area 307.

Figure 4:
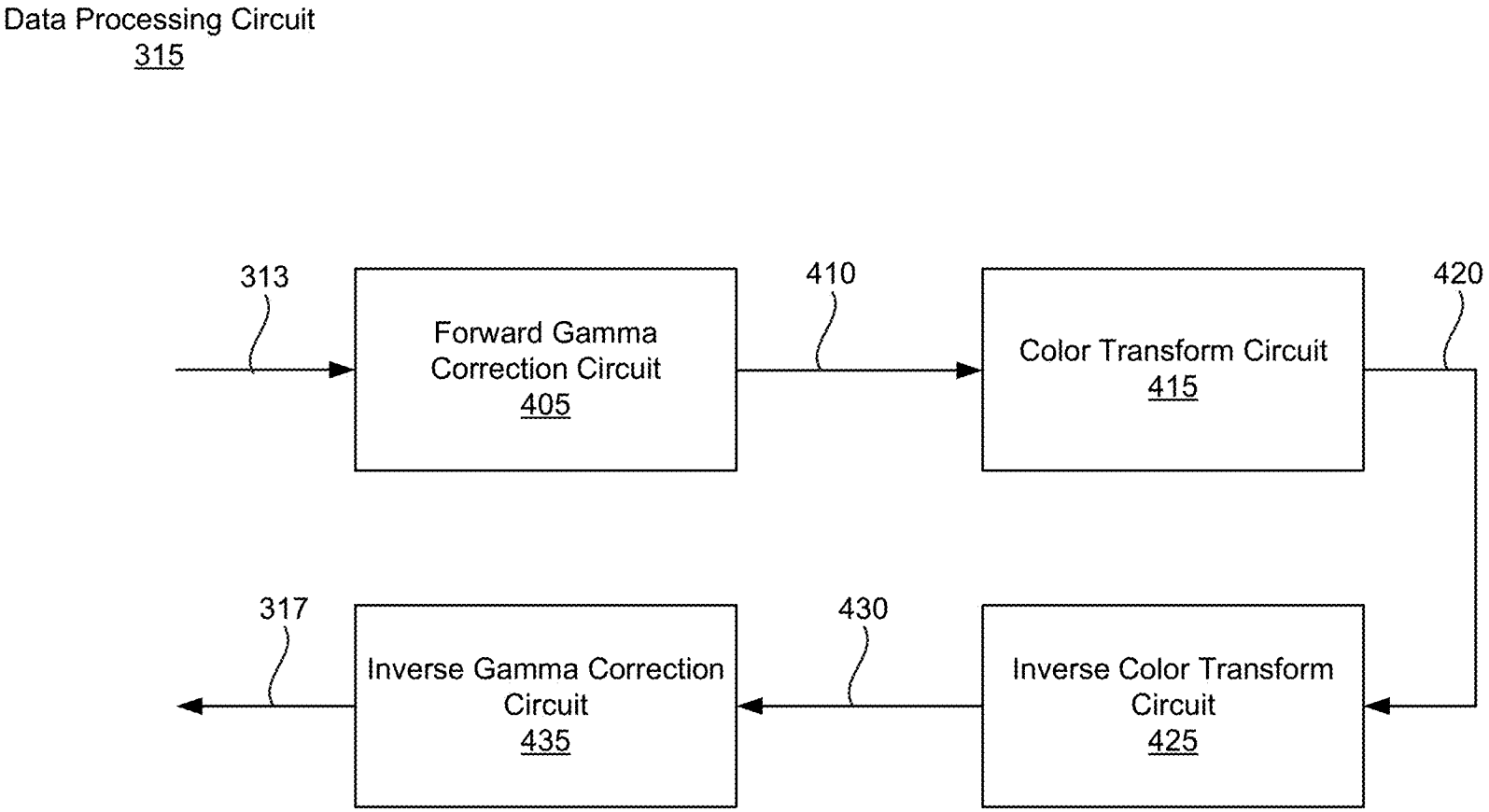
FIG. 4 is a block diagram of a portion of a data processing circuit of the display assembly in FIG. 3 that performs a color conversion process, according to some embodiments.

FIG. 4 is a block diagram of a portion of the data processing circuit 315 that performs the color conversion process, according to some embodiments. The data processing circuit 315 may include a forward gamma correction circuit 405 coupled to the color transform circuit 415. The data processing circuit 315 may further include an inverse color transform circuit 425 coupled to the color transform circuit 415 and an inverse gamma correction circuit 435 coupled to the inverse color transform circuit 425. There may be more or fewer components of the data processing circuit 315 than what is shown in FIG. 4.

The forward gamma correction circuit 405 may perform a forward gamma correction of the pixel values 313 of the first format (e.g., RGB format) to obtain linearized pixel values 410 of the first format. The forward gamma correction circuit 405 may perform the forward gamma correction by applying a specific gamma curve to the pixel values 313, and the gamma curve is defined by the gamma coefficient of, e.g., $\gamma=2.4$. The linearized pixel values 410 may be passed onto the color transform circuit 415. The specific gamma curve (i.e., value of the gamma coefficient) applied at the forward gamma correction circuit 405 may be obtained during the color calibration process.

The color transform circuit 415 may perform a color transformation of the linearized pixel values 410 of the first format into linearized transformed pixel values 420 of the second format (e.g., XYZ format). The color transform circuit 415 may perform the color transformation by applying the color transform matrix to the linearized pixel values 410 of RGB color components for each pixel of the image data DATA input into the data processing circuit 315. The color transform matrix applied at the color transform circuit 415 may be determined during the color calibration process. The linearized transformed pixel values 420 of the second format may be passed onto the inverse color transform circuit 425.

The inverse color transform circuit 425 may perform an inverse color transform of the linearized transformed pixel values 420 of the second format to generate linearized transformed pixel values 430 of the first format (e.g., RGB format), for example, by applying another color transform matrix to the linearized transformed pixel values 420 of XYZ color components for each pixel of the image data DATA input into the data processing circuit 315. The other color transform matrix may correspond to a version of the color transform matrix previously applied at the color transform circuit 415 (e.g., proportional to an inverse of the color transform matrix). The linearized transformed pixel values 430 of the first format may be passed onto the inverse gamma correction circuit 435.

The inverse gamma correction circuit 435 may perform an inverse gamma correction (i.e., degamma process) of the linearized transformed pixel values 430 of the first format to generate the corrected (or transformed) pixel values 317 suitable for presentation at the display active area 307. The inverse gamma correction circuit 435 may perform the inverse gamma correction by applying a specific inverse gamma curve (i.e., degamma curve) to the linearized transformed pixel values 430. The inverse gamma curve applied at the inverse gamma correction circuit 435 may be defined by a specific degamma coefficient, e.g., the degamma coefficient $1/\gamma=1/2.4$. The value of the degamma coefficient applied at the inverse gamma correction circuit 435 may be related to the gamma coefficient of the forward gamma correction circuit 405 obtained during the color calibration process. In one or more embodiments, the inverse gamma correction circuit 435 includes one or more look-up tables with degamma coefficients (or gamma coefficients) for different temperatures.

The color conversion process depends on the color transform matrices (e.g., applied at color transform circuit 415 and the inverse color transform circuit 425) and gamma curves defined by the gamma coefficients (e.g., applied at the forward gamma correction circuit 405 and the inverse gamma correction circuit 435). It is therefore desirable to obtain accurate color transform matrices and gamma coefficients during the calibration process. However, the color, luminance (i.e., color transform matrices), and/or gamma coefficients (i.e., gamma curves) of the display active areas 307 (e.g., implemented as LCD displays or OLED displays) typically shift with an operating temperature. As the color calibration is typically performed at a defined initial temperature (e.g., between 25° C. and 30° C.), a color transform matrix and gamma curve obtained at the initial temperature would predict wrong colors at higher operating temperatures of the display active areas 307 (e.g., between 40° C. and 60° C.). Embodiments presented herein are directed to updating the color transform matrices and gamma curves with real-time temperature information for color conversion under thermal shifts.

Figure 5:
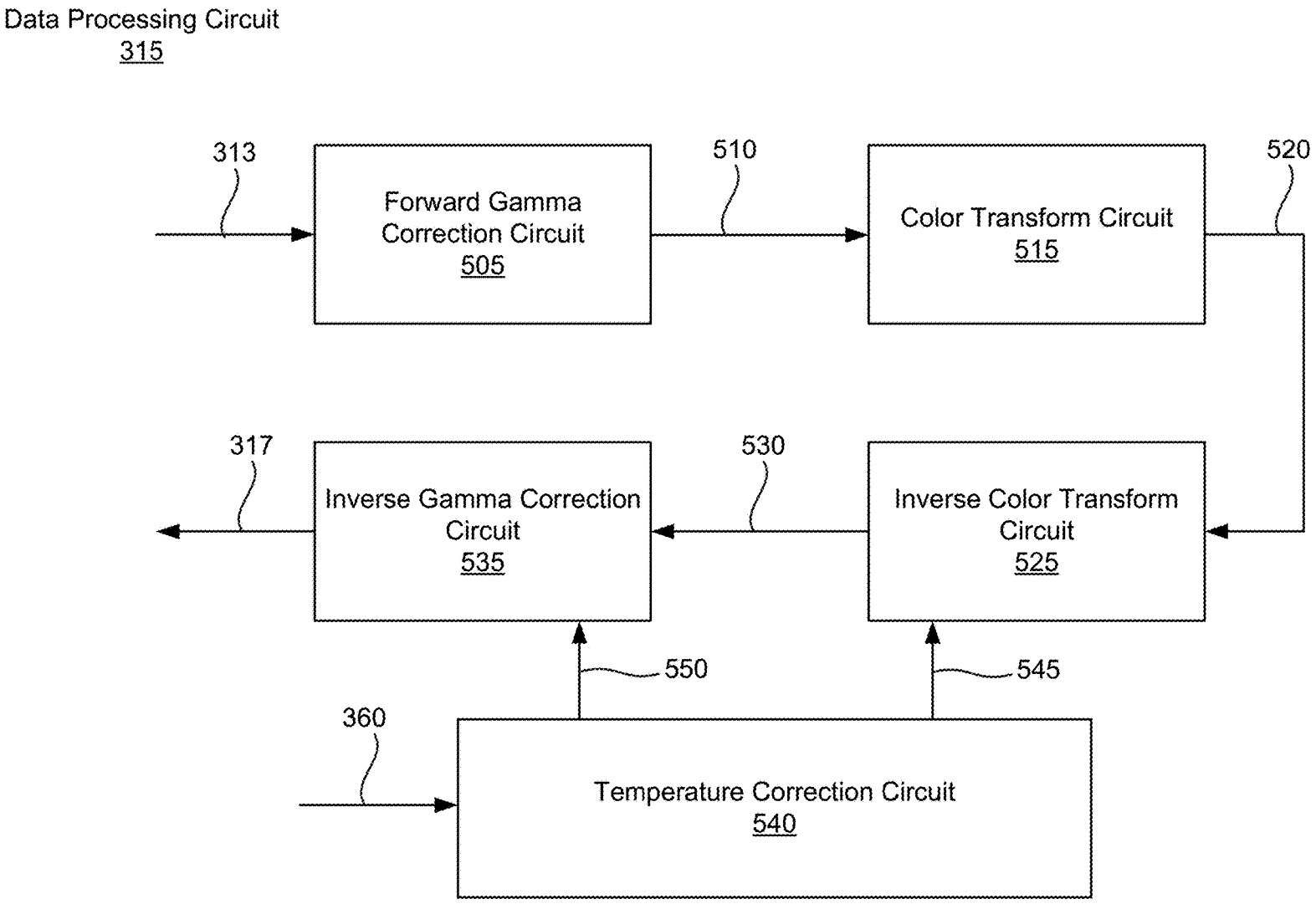
FIG. 5 is a block diagram of a portion of a data processing circuit of the display assembly in FIG. 3 that performs a color conversion process with real-time temperature correction, according to some embodiments.

FIG. 5 is a block diagram of a portion of the data processing circuit 315 that performs the color conversion process with real-time temperature correction, according to some embodiments. The data processing circuit 315 may include a forward gamma correction circuit 505 coupled to the color transform circuit 515, an inverse color transform circuit 525 coupled to the color transform circuit 515, and an inverse gamma correction circuit 535 coupled to the inverse color transform circuit 525. The data processing circuit may further include a temperature correction circuit 540 coupled to the inverse gamma correction circuit 535 and the inverse color transform circuit 525. There may be more or fewer components of the data processing circuit 315 than what is shown in FIG. 5.

The forward gamma correction circuit 505 may perform a forward gamma correction of the pixel values 313 of the first format (e.g., RGB format) to obtain linearized pixel values 510 of the first format. The forward gamma correction circuit 505 may perform the forward gamma correction by applying a gamma curve defined by the gamma coefficient of, e.g., $\gamma=2.4$. The color transform circuit 515 may perform a color transformation of the linearized pixel values 510 of the first format into linearized transformed pixel values 420 of the second format (e.g., XYZ format). The color transform circuit 515 may perform the color transformation by applying a color transform matrix (obtained during the color calibration) to the linearized pixel values 510 for each pixel of the image data DATA. The inverse color transform circuit 525 may perform an inverse color transform of the linearized transformed pixel values 520 of the second format to generate linearized transformed pixel values 530 of the first format (e.g., RGB format). The inverse color transform circuit 525 may perform the inverse color transform by applying a version of the color transform matrix to the linearized transformed pixel values 520 for each pixel of the image data DATA. The inverse gamma correction circuit 535 may perform an inverse gamma correction (i.e., degamma process) of the linearized transformed pixel values 530 of the first format to generate transformed (or corrected) pixel values 317 suitable for presentation at the display active area 307. The inverse gamma correction circuit 435 may perform the inverse gamma correction by applying a degamma curve defined by the inverse of gamma coefficient, e.g., $1/\gamma=1/2.4$.

The forward gamma correction circuit 505, the color transform circuit 515, the inverse color transform circuit 525, and the inverse gamma correction circuit 535 in FIG. 5 perform substantially the same operations as corresponding components the forward gamma correction circuit 405, the color transform circuit 415, the inverse color transform circuit 425, and the inverse gamma correction circuit 435 in FIG. 4. However, the color transform matrix (e.g., applied at the inverse color transform circuit 525) and the gamma coefficient (e.g., used at the inverse gamma correction circuit 535) may be updated using the real-time temperature information 360 for the display active area 307 measured by the temperature sensor assembly 355.

The temperature correction circuit 540 may generate elements 545 of a color transform matrix updated based on the real-time temperature information 360 and provide the elements 545 to, e.g., the inverse color transform circuit 525. Furthermore, the temperature correction circuit 540 may derive an updated gamma coefficient 550 using the real-time temperature information 360 and provide the updated gamma coefficient 550 to, e.g., the inverse gamma correction circuit 535. The temperature correction circuit 540 may receive the real-time temperature information 360 from the display panel 302.

The color transform matrix can be determined considering that pixels of the display active area 307 assures scalability and additivity. The scalability of color transform matrix means that an intensity of a primary color is equal to the multiplication of a scalar and a maximum intensity of the primary color. Thus, the following equation holds:

$$L_{\lambda,r}=RL_{\lambda,rmax}, \quad (1)$$

where $L_{\lambda,r}$ is an intensity (i.e., luminance) of the primary red color, R is a scalar for the primary red color, and $L_{\lambda,rmax}$ is a maximum intensity (i.e., maximum luminance) of the primary red color. The additivity of color transform matrix can be experimentally verified and means that any color in the color gamut of display active area 307 can be expressed as a sum of the three primary colors (i.e., red, green, and blue). Thus, the following equation holds:

$$L_\lambda = L_{\lambda,r} + L_{\lambda,g} + L_{\lambda,b}, \tag{2}$$

where $L_{\lambda,g}$ is an intensity (i.e., luminance) of the primary green color, $L_{\lambda,b}$ is an intensity (i.e., luminance) of the primary blue color, and $L_\lambda$ is a total color intensity (i.e., total color luminance).

By considering scalability and additivity of the color transform matrix, the color transformation applied at the color transform circuit 515 can be defined as:

$$\begin{pmatrix} X_t \\ Y_t \\ Z_t \end{pmatrix} = \begin{pmatrix} X_R & X_G & X_B \\ Y_R & Y_G & Y_B \\ Z_R & Z_G & Z_B \end{pmatrix} \begin{pmatrix} r \\ g \\ b \end{pmatrix}, \tag{3}$$

where ($X_R$, $X_G$, $X_B$, $X_R$, $X_G$, $X_B$, $X_R$, $X_G$, $X_B$) are color transform elements, i.e., elements of the color transform matrix; (r, g, b) are color components of the linearized pixel values 510 in the first format (e.g., RGB format); and ($X_t$, $Y_t$, $Z_t$) are color components of the linearized transformed pixel values 520 in the second format (e.g., XYZ format) at an operating temperature t. Hence, for the color transform matrix in Equation (3), ($X_t$, $Y_t$, $Z_t$) components indicate the white color, where r=g=b=1.

The white color typically becomes bluish with the increase in an operating temperature of the display active area 307. This effect can be represented by adding a fraction of B (blue) component to an intensity of the white color with the increase in operating temperature, i.e., $$W_{T1} = W_{T0} + a \times R_{T0} + b \times G_{T0} + c \times B_{T0}, \tag{4}$$

where $W_{T1}$ is a white color thermal shift at an operating temperature T1; $W_{T0}$ is a white color thermal shift at an initial temperature T0; ($R_{T0}$, $G_{T0}$, $B_{T0}$) are intensities of color components in the first format (e.g., RGB format) at the initial temperature T0; and (a, b, c) are scalars defining addition of corresponding fractures of primary colors to the white color thermal shift (e.g., a=b=0).

Equation (4) can be extended to thermal shifts of RGB color components, which can be expressed as:

$$\begin{pmatrix} X_{R,T1} & X_{G,T1} & X_{B,T1} \\ Y_{R,T1} & Y_{G,T1} & Y_{B,T1} \\ Z_{R,T1} & Z_{G,T1} & Z_{B,T1} \end{pmatrix} = \begin{pmatrix} X_{R,T0} & X_{G,T0} & X_{B,T0} \\ Y_{R,T0} & Y_{G,T0} & Y_{B,T0} \\ Z_{R,T0} & Z_{G,T0} & Z_{B,T0} \end{pmatrix} \begin{pmatrix} k_1 & k_4 & k_7 \\ k_2 & k_5 & k_8 \\ k_3 & k_6 & k_9 \end{pmatrix}, \tag{5}$$

where ($X_{R,T1}$, $X_{G,T1}$, $X_{B,T1}$, $X_{R,T1}$, $X_{G,T1}$, $X_{B,T1}$, $X_{R,T1}$, $X_{G,T1}$, $X_{B,T1}$) are color transform elements (i.e., elements of a color transform matrix) at the operating temperature T1; ($X_{R,T0}$, $X_{G,T0}$, $X_{B,T0}$, $X_{R,T0}$, $X_{G,T0}$, $X_{B,T0}$, $X_{R,T1}$, $X_{G,T0}$, $X_{B,T0}$) are color transform elements (i.e., elements of a color transform matrix) at the initial temperature T0; and ($k_1$, $k_2$, . . . , $k_9$) are color compensation coefficients, i.e., elements of a color compensation matrix.

Equation (5) indicates that the color transform matrix at the operating temperature T1 can be computed (e.g., as part of at the temperature correction circuit 540) using a known color transform matrix at the initial temperature T0 and the color compensation coefficients. Since thermal color shifts are consistent in direction or orientation across different displays, a single set of the color compensation coefficients ($k_1$, $k_2$, . . . , $k_9$) can be employed across various displays.

Figure 6:
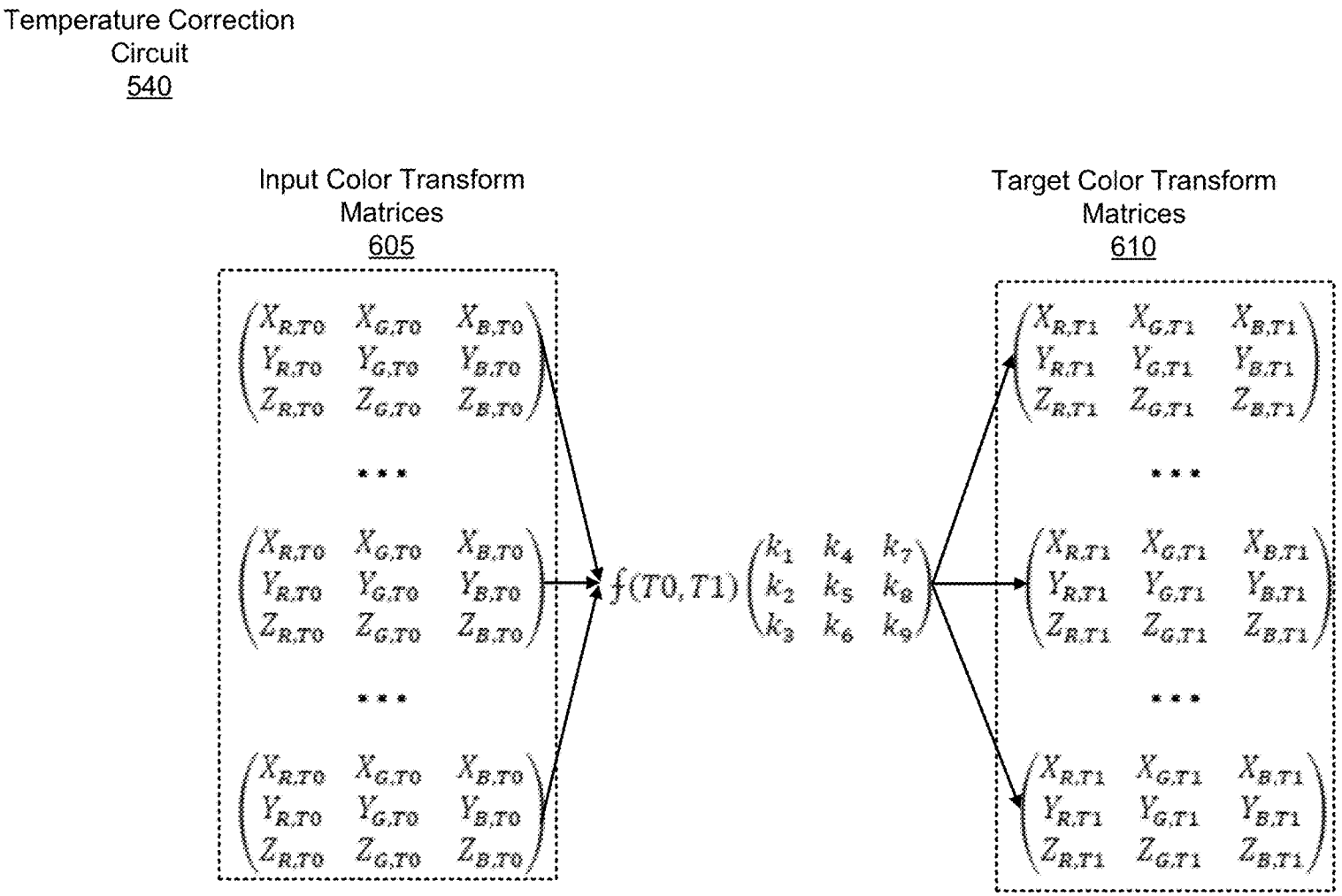
FIG. 6 illustrates a machine learning process at the data processing circuit in FIG. 5 for determining color compensation coefficients for color thermal shifts, according to some embodiments.

FIG. 6 illustrates a machine learning process at the temperature correction circuit 540 for determining the color compensation coefficients, according to some embodiments. First, a set of input color transform matrices 605 may be formed by measuring and calibrating a set of displays at initial temperature ranges (e.g., between 25° C. and 30° C.). Then, the same procedure may be repeated at operating temperature ranges (e.g., between 40° C. and 60° C.) to form a set of target color transform matrices 610. The color compensation coefficients ($k_1$, $k_2$, . . . , $k_9$) of the compensation matrix may be determined, e.g., by minimizing an average difference between the input color transform matrices 605 and the target color transform matrices 610. This may be achieved via a supervised machine learning performed at the temperature correction circuit 540.

To cover a defined range of operating temperatures (e.g., between 40° C. and 60° C.), a compensation function depending on an initial temperature T0 and an operating temperature T1 (i.e., the compensation function $f$(T0, T1)) may be used to adjust the color compensation coefficients ($k_1$, $k_2$, . . . , $k_9$) according to information about a given operating temperature T1 (e.g., obtained as the real-time temperature information 360). As shown in FIG. 6, the color compensation coefficients ($k_1$, $k_2$, . . . , $k_9$) may be scaled by a corresponding value of the compensation function $f$(T0, T1).

As aforementioned, the gamma curves applied at the data processing circuit 315 significantly vary with operating temperatures. Referring to FIG. 5, if a fixed gamma coefficient is used for color conversion (e.g., at the inverse gamma correction circuit 535), the color conversion would result in predicting wrong colors for presentation at the display active areas 307. In one embodiment, the temperature correction circuit 540 generates a gamma lookup table with gamma coefficients 550 for different operating temperatures. The temperature correction circuit 540 may provide the gamma lookup table of the gamma coefficients 550 to, e.g., the inverse gamma correction circuit 535 for achieving an improved accuracy of representing actual gamma curves under thermal shifts. In another embodiment, the temperature correction circuit 540 derives a gamma curve shift 550 for a specific operating temperature using the real-time temperature information 360. For example, the gamma curve shift 550 can be expressed as a linear regression function of an operating temperature, i.e., $$Y = -0.01 \times T + 2.65 (25 \le T \le 65), \tag{6}$$

where Y is a luma and Tis an operating temperature obtained via the real-time temperature information 360. The value of luma may be provided as the gamma curve shift 550 to, e.g., the inverse gamma correction circuit 535.

Figure 7:
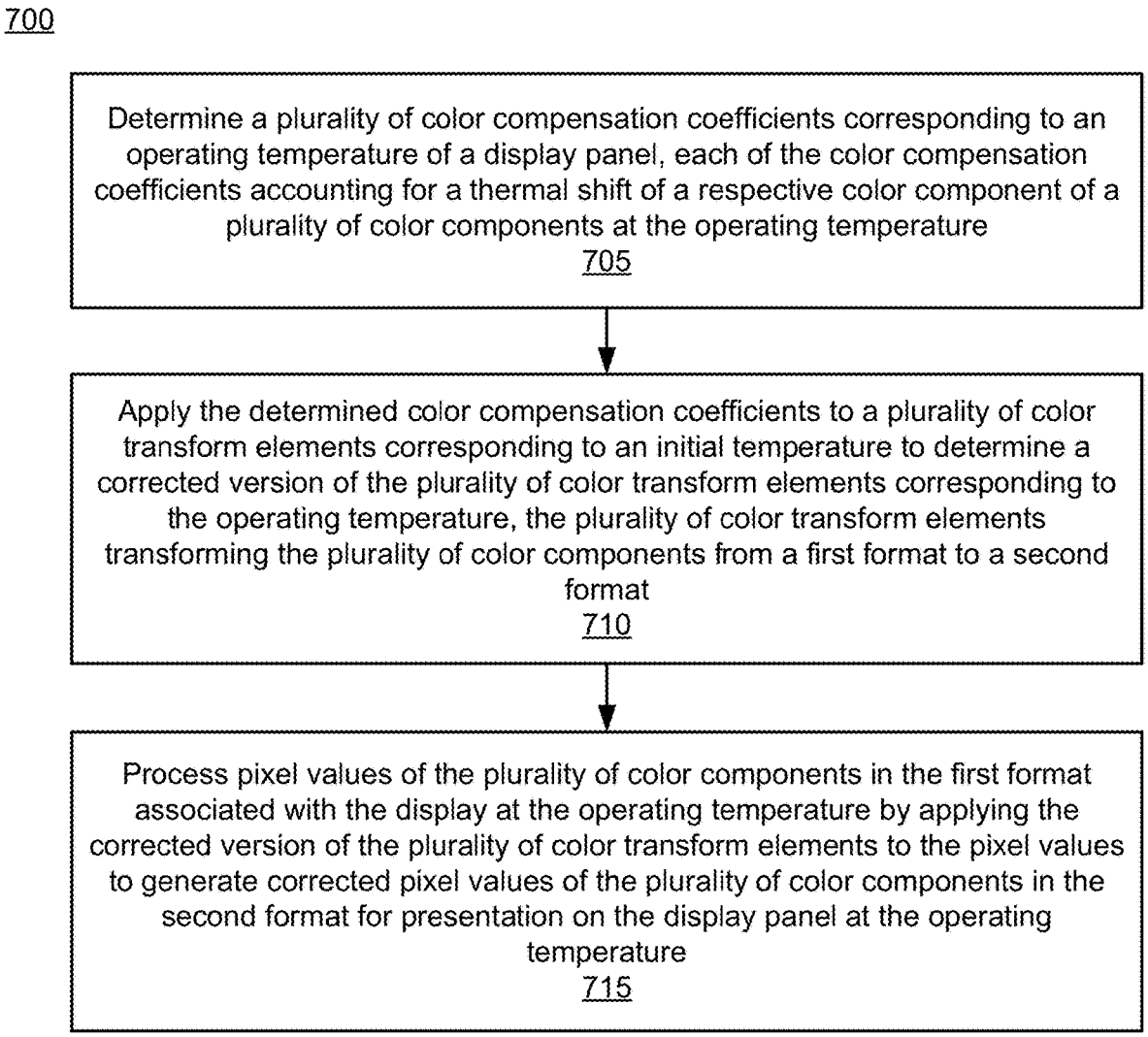
FIG. 7 is a flowchart illustrating a process for color conversion with real-time temperature correction, according to some embodiments.

FIG. 7 is a flowchart illustrating a process 700 for color conversion with real-time temperature correction, according to some embodiments. The process 700 shown in FIG. 7 may be performed by components of a display assembly (e.g., components of the display assembly 300). Other entities may perform some or all of the steps in FIG. 7 in other embodiments. Embodiments may include different and/or additional steps, or perform the steps in different orders.

The display assembly determines 705 (e.g., by the data processing circuit 315) a plurality of color compensation coefficients corresponding to an operating temperature of a display panel (e.g., the display panel 302), each of the color compensation coefficients accounting for a thermal shift of a respective color component of a plurality of color components at the operating temperature. The display assembly may determine (e.g., by the data processing circuit 315) the plurality of color compensation coefficients using a compensation function that depends on the initial temperature and the operating temperature. The display assembly may determine (e.g., by the data processing circuit 315) the plurality of color compensation coefficients by minimizing an average difference between each of the plurality of color transform elements and a respective color transform element of the target version of the plurality of color transform elements. The operating temperature may be higher than the initial temperature. The determined color compensation coefficients may form, e.g., a 3×3 color compensation matrix.

In some embodiments, the display assembly determines (e.g., via the data processing circuit 315) the plurality of color compensation coefficients by applying a machine learning to an input comprising the plurality of color transform elements to obtain an output comprising a target version of the plurality of color transform elements associated with a target temperature different than the initial temperature and the operating temperature. The input may comprise a first plurality of color transform matrices each including a respective subset of the plurality of color transform elements, and the output may comprise a second plurality of color transform matrices each including a respective subset of the target version of the plurality of color transform elements. During the machine learning, the display assembly may map (e.g., via the data processing circuit 315) each of the first plurality of color transform matrices to a respective color transform matrix of the second plurality of color transform matrices by applying the plurality of color compensation coefficients to the respective subset of the plurality of color transform elements.

The display assembly applies 710 (e.g., by the data processing circuit 315) the determined color compensation coefficients to a plurality of color transform elements corresponding to an initial temperature to determine a corrected version of the plurality of color transform elements corresponding to the operating temperature, the plurality of color transform elements transforming the plurality of color components from a first format to a second format. The first format may be, e.g., XYZ format, and the second format may be, e.g., RGB format.

The display assembly processes 715 (e.g., by the data processing circuit 315) pixel values of the plurality of color components in the first format associated with the display panel at the operating temperature by applying the corrected version of the plurality of color transform elements to the pixel values to generate corrected pixel values of the plurality of color components in the second format for presentation on the display panel at the operating temperature. The display assembly may apply (e.g., by the data processing circuit 315) at least one of an inverse color transform and an inverse gamma correction to the pixel values using the corrected version of the plurality of color transform elements to generate the corrected pixel values.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

determining a plurality of color compensation coefficients corresponding to an operating temperature of a display panel, each of the color compensation coefficients accounting for a thermal shift of a respective color component of a plurality of color components at the operating temperature;

applying the determined color compensation coefficients to a plurality of color transform elements corresponding to an initial temperature to determine a corrected version of the plurality of color transform elements corresponding to the operating temperature, the plurality of color transform elements transforming the plurality of color components from a first format to a second format; and processing pixel values of the plurality of color components in the first format associated with the display panel at the operating temperature by applying at least one of an inverse color transform and an inverse gamma correction to the pixel values using the corrected version of the plurality of color transform elements to generate corrected pixel values of the plurality of color components in the second format for presentation on the display panel at the operating temperature.

2. The method of claim 1, further comprising:

determining the plurality of color compensation coefficients using a compensation function that depends on the initial temperature and the operating temperature.

3. The method of claim 1, wherein the operating temperature is higher than the initial temperature.

4. The method of claim 1, wherein the determined color compensation coefficients form a 3×3 color compensation matrix.

5. The method of claim 1, further comprising:

determining the plurality of color compensation coefficients by applying a machine learning to an input comprising the plurality of color transform elements to obtain an output comprising a target version of the plurality of color transform elements associated with a target temperature different than the initial temperature and the operating temperature.

6. The method of claim 5, wherein:

the input comprises a first plurality of color transform matrices each including a respective subset of the plurality of color transform elements; and the output comprises a second plurality of color transform matrices each including a respective subset of the target version of the plurality of color transform elements.

7. The method of claim 6, further comprising:

mapping, during the machine learning, each of the first plurality of color transform matrices to a respective color transform matrix of the second plurality of color transform matrices by applying the plurality of color compensation coefficients to the respective subset of the plurality of color transform elements.

8. The method of claim 5, further comprising:

measuring the plurality of color transform elements for one or more display panels at the initial temperature; and measuring the target version of the plurality of color transform elements for the one or more display panels at the target temperature.

9. The method of claim 5, further comprising:

determining the plurality of color compensation coefficients by minimizing an average difference between each of the plurality of color transform elements and a respective color transform element of the target version of the plurality of color transform elements.

10. A display assembly comprising:

a display panel configured to display images; and a data processing circuit coupled to the display panel, the data processing circuit configured to:

determine a plurality of color compensation coefficients corresponding to an operating temperature of the display panel, each of the color compensation coefficients accounting for a thermal shift of a respective color component of a plurality of color components at the operating temperature, apply the determined color compensation coefficients to a plurality of color transform elements corresponding to an initial temperature to determine a corrected version of the plurality of color transform elements corresponding to the operating temperature, the plurality of color transform elements transforming the plurality of color components from a first format to a second format, process pixel values of the plurality of color components in the first format associated with the display panel at the operating temperature by applying at least one of an inverse color transform and an inverse gamma correction to the pixel values using the corrected version of the plurality of color transform elements to generate corrected pixel values of the plurality of color components in the second format for presentation on the display panel at the operating temperature, and instruct the display panel to present the corrected pixel values.

11. The display assembly of claim 10, wherein the data processing circuit is further configured to:

determine the plurality of color compensation coefficients using a compensation function that depends on the initial temperature and the operating temperature.

12. The display assembly of claim 10, wherein:

the operating temperature is higher than the initial temperature; and the determined color compensation coefficients form a 3×3 color compensation matrix.

13. The display assembly of claim 10, wherein the data processing circuit is further configured to:

determine the plurality of color compensation coefficients by applying a machine learning to an input comprising the plurality of color transform elements to obtain an output comprising a target version of the plurality of color transform elements associated with a target temperature different than the initial temperature and the operating temperature.

14. The display assembly of claim 13, wherein:

the input comprises a first plurality of color transform matrices each including a respective subset of the plurality of color transform elements;

the output comprises a second plurality of color transform matrices each including a respective subset of the target version of the plurality of color transform elements; and the data processing circuit is further configured to map, during the machine learning, each of the first plurality of color transform matrices to a respective color transform matrix of the second plurality of color transform matrices by applying the plurality of color compensation coefficients to the respective subset of the plurality of color transform elements.

15. The display assembly of claim 10, wherein the display assembly is part of a headset.

16. A non-transitory computer-readable storage medium having instructions encoded thereon that, when executed by a processor, cause the processor to:

determine a plurality of color compensation coefficients corresponding to an operating temperature of a display panel, each of the color compensation coefficients accounting for a thermal shift of a respective color component of a plurality of color components at the operating temperature;

apply the determined color compensation coefficients to a plurality of color transform elements corresponding to an initial temperature to determine a corrected version of the plurality of color transform elements corresponding to the operating temperature, the plurality of color transform elements transforming the plurality of color components from a first format to a second format; and process pixel values of the plurality of color components in the first format associated with the display panel at the operating temperature by applying at least one of an inverse color transform and an inverse gamma correction to the pixel values using the corrected version of the plurality of color transform elements to generate corrected pixel values of the plurality of color components in the second format for presentation on the display panel at the operating temperature.

17. The non-transitory computer-readable storage medium of claim 16, wherein the instructions further cause the processor to:

determine the plurality of color compensation coefficients using a compensation function that depends on the initial temperature and the operating temperature.

18. The non-transitory computer-readable storage medium of claim 16, wherein the instructions further cause the processor to:

determine the plurality of color compensation coefficients by applying a machine learning to an input comprising the plurality of color transform elements to obtain an output comprising a target version of the plurality of color transform elements associated with a target temperature different than the initial temperature and the operating temperature.

* * * * *